US011933112B2

(12) United States Patent
Roessler

(10) Patent No.: US 11,933,112 B2
(45) Date of Patent: Mar. 19, 2024

(54) HYDRAULICALLY POWERED CENTRALIZER DEVICE FOR BOREHOLE AND METHOD

(71) Applicant: GEODYNAMICS, INC., Millsap, TX (US)

(72) Inventor: Dennis Roessler, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 77 days.

(21) Appl. No.: 17/335,351

(22) Filed: Jun. 1, 2021

(65) Prior Publication Data

US 2021/0381322 A1 Dec. 9, 2021

Related U.S. Application Data

(60) Provisional application No. 63/035,899, filed on Jun. 8, 2020.

(51) Int. Cl.

| | |
|---|---|
| ***E21B 17/10*** | (2006.01) |
| ***E21B 23/04*** | (2006.01) |
| ***E21B 43/117*** | (2006.01) |
| ***E21B 43/119*** | (2006.01) |

(52) U.S. Cl.

CPC ..... *E21B 17/1021* (2013.01); *E21B 23/04* (2013.01); *E21B 43/117* (2013.01); *E21B 43/119* (2013.01)

(58) Field of Classification Search

CPC .... E21B 17/1021; E21B 23/04; E21B 43/117; E21B 43/119

See application file for complete search history.

(56) References Cited

U.S. PATENT DOCUMENTS

| | | | | |
|---|---|---|---|---|
| 4,619,322 | A * | 10/1986 | Armell | E21B 17/1021 166/241.5 |
| 4,790,381 | A * | 12/1988 | Armell | E21B 17/1021 166/241.5 |
| 5,358,039 | A | 10/1994 | Fordham | |
| 5,680,049 | A * | 10/1997 | Gissler | E21B 23/14 324/371 |
| 6,173,773 | B1 | 1/2001 | Almaguer et al. | |
| 6,629,568 | B2 * | 10/2003 | Post | E21B 23/04 166/241.1 |
| 2005/0247488 | A1 * | 11/2005 | Mock | E21B 4/18 166/212 |

(Continued)

*Primary Examiner* — Theodore N Yao

(74) *Attorney, Agent, or Firm* — Morgan, Lewis & Bockius, LLP

(57) ABSTRACT

A centralizing device is configured to centralize/decentralize an associated tool in a well. The centralizing device includes a body that extends along a longitudinal axis X, the body having a bore that extends from one end to another end of the body; a first piston shaped as a cylinder and provided around a central portion of the body; a second piston shaped as a cylinder and provided around the central portion of the body; a bridge provided around the central portion of the body, between the first and second pistons; and a pair of arms, each arm being attached with one end to a corresponding one of the first and second pistons and with another end to each other. The second piston, the bridge, and the central portion of the body define a sealed chamber, which is sealed from the ambient.

14 Claims, 11 Drawing Sheets

(56) References Cited

U.S. PATENT DOCUMENTS

| | | | | |
|---|---|---|---|---|
| 2011/0048702 | A1* | 3/2011 | Jacob | E21B 47/01 175/45 |
| 2014/0246210 | A1* | 9/2014 | Andersen | E21B 17/1021 166/212 |
| 2015/0034336 | A1* | 2/2015 | Morrison | E21B 17/1028 166/381 |
| 2018/0010407 | A1* | 1/2018 | Jaaskelainen | E21B 33/14 |
| 2019/0383108 | A1 | 12/2019 | Massey et al. | |

* cited by examiner

HYDRAULICALLY POWERED CENTRALIZER DEVICE FOR BOREHOLE AND METHOD

BACKGROUND

Technical Field

Embodiments of the subject matter disclosed herein generally relate to centralizing a tool that is lowered into a casing of a well, and more specifically, to a centralizing device that is capable, by only using hydraulic pressure, to centralize or decentralize and/or orient the tool relative to the casing of the well.

Discussion of the Background

In the oil and gas field, once a well is drilled to a desired depth H relative to the surface, and the casing protecting the wellbore has been installed and cemented in place, it is time to connect the wellbore to the subterranean formation to extract the oil and/or gas. This process of connecting the wellbore to the subterranean formation may include a step of fluidly insulating with a plug a previously fractured stage of the well, a step of perforating a portion of the casing, which corresponds to a new stage, with a perforating gun such that various channels are formed to connect the subterranean formation to the inside of the casing, a step of removing the perforating gun, and a step of fracturing the various channels of the new stage by pumping a fluid into the channels. These steps are repeated until all the stages of the well are fractured.

During one or more of these steps, it is often the case that a tool present inside the well needs to be centralized or decentralized relative to the casing of the well. This is especially true if the well is a horizontal well. A centralized tool, for example, the perforating gun, ensures that the water thickness between the casing of the well and the housing of the perforating gun is the same. This water thickness may be important for some perforating scenarios, as a shaped charge inside the perforating gun would make a certain perforation in the casing of the well, depending on the water thickness. In other words, if the perforating gun 110 shown in FIG. 1, which is part of a perforating system 100, sits directly on the casing 120 of the well 122, it is apparent that a water thickness D1 between the shaped charge 112, which is oriented vertically upward, and the casing 120, is much larger than a thickness D2 between another shaped charge 114, which is oriented vertically downward, and the casing 120. This means that when the shaped charges are fired, a first perforation 113 generated in the casing 120 by the first shaped charge 112 has a much smaller diameter than a second perforation 115, which is generated by the second shaped charge 114. This is so because the melted material generated by the shaped charge 112 has to travel through the ambient water 116 (in fact a mud or slurry mixed with water) that is present in the casing 120, before interacting with the casing 120, which not only cools down the melted material, but also may change its shape. To the contrary, for the shaped charge 114, which is effectively not affected by the water 116 within the casing 120, there is no or minimal influence on the melted material from the ambient water, and thus, a larger perforation 115 is obtained. Thus, for this arrangement of the charges, it is not possible to obtain equal sizes for the above and below perforations if the shaped charges 112 and 114 are identical. To overcome this problem, some operators are using different shaped charges for the same perforating gun. However, this approach is undesired because it require to store in the field plural size shaped charges, and also requires the operator of the perforating gun to not make any mistake in terms of the sizes of the charges and their position.

Thus, there is a need to provide a device for centralizing the perforating gun 110 relative to the casing 120. While such centralizers are known in the art, they are either very cumbersome and have many parts, which are prone to fail in the harsh environment inside the casing, or they require a force to act on a spring mechanism for actuating the arms of the centralizer. Thus, there is a need for a new centralizer that not only is simple and can withstand the conditions inside the well, but also that can be activated without the use of a spring mechanism.

FIG. 1 also shows that the perforating gun 110 can be attached to a wireline 130, that is controlled by a controller 132, which is located at the surface 134. The subsurface 136 may include one or more formations 138, that hold oil and/or gas. The perforating gun 110 is typically placed in the casing 120, next to the formations 138, to perforate the casing and establish the fluid communication between the bore of the casing 120 and the formation 138, so that the oil from the formation can enter the casing and the perforation fluid from the casing can be pumped into the formation to create the tunnels, to effectively fracture the formation.

In addition to the need to centralize the perforating gun or other tools inside the casing in the well, there is also a desire in the art to orient the perforating guns so that the shaped charges are fired along desired directions. With a traditional perforating gun this is difficult. Thus, there is a further need to have not only a more efficient centralizer, but also to have a centralizer that is capable of orienting the shaped charges as desired.

SUMMARY

According to an embodiment, there is a centralizing device configured to centralize/decentralize an associated tool in a well. The centralizing device includes a body that extends along a longitudinal axis X, the body having a bore that extends from one end to another end of the body, a first piston shaped as a cylinder and provided around a central portion of the body, a second piston shaped as a cylinder and provided around the central portion of the body, a bridge provided around the central portion of the body, between the first and second pistons, and a pair of arms, each arm being attached with one end to a corresponding one of the first and second pistons and with another end to each other. The second piston, the bridge, and the central portion of the body define a sealed chamber, which is sealed from the ambient.

According to another embodiment, there is a well assembly configured to be deployed in a well, the well assembly including a perforating gun having plural shaped charges and configured to perforate a casing of the well, and a centralizing body attached to the perforating gun and configured to centralize the perforating gun relative to the casing exclusively based on a hydrostatic pressure inside the casing.

According to still another embodiment, there is a method for manufacturing a centralizing device to be attached to a perforating gun. The method includes providing a body that has threads at one end to be attached to the perforating gun; attaching a first piston around a central region of the body; attaching a second piston around the central region of the body; attaching a bridge around the central region of the body, to separate the first piston from the second piston; and creating a sealed room defined by the second piston, the bridge, and the body, wherein the sealed room is sealed from the ambient.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a perforating gun used for perforating a casing in a horizontal well. However, the embodiments discussed herein may be used for other tools that are used in a well or for tools that are provided inside a vertical well.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, one or more well tools, e.g., a perforating gun, a setting tool, etc., are assembled to each other and lowered into the well. One or more centralizing devices may be connected between adjacent tools. A centralizing device includes one or more pistons that are configured to move along a longitudinal axis of the centralizing device, exclusively due to the hydrostatic pressure present inside the well. The movement of the one or more pistons makes the arms linked to the one or more pistons to extend radially, away from the body of the centralizing device, so that the arms eventually touch the casing of the well, and implicitly the arms centralize the tool. Plural arms may be associated with a given centralizing device. No springs or other means for actuating the arms are used except for the pistons and the hydrostatic pressure. In one application, the number of arms can be selected in such a way to decentralize the tool instead of centralizing it. In still another application, the arms may be provided with weights and/or rotating means for orienting the tool inside the casing as desired. The details of these features are now discussed with regard to the figures.

Figure 1:
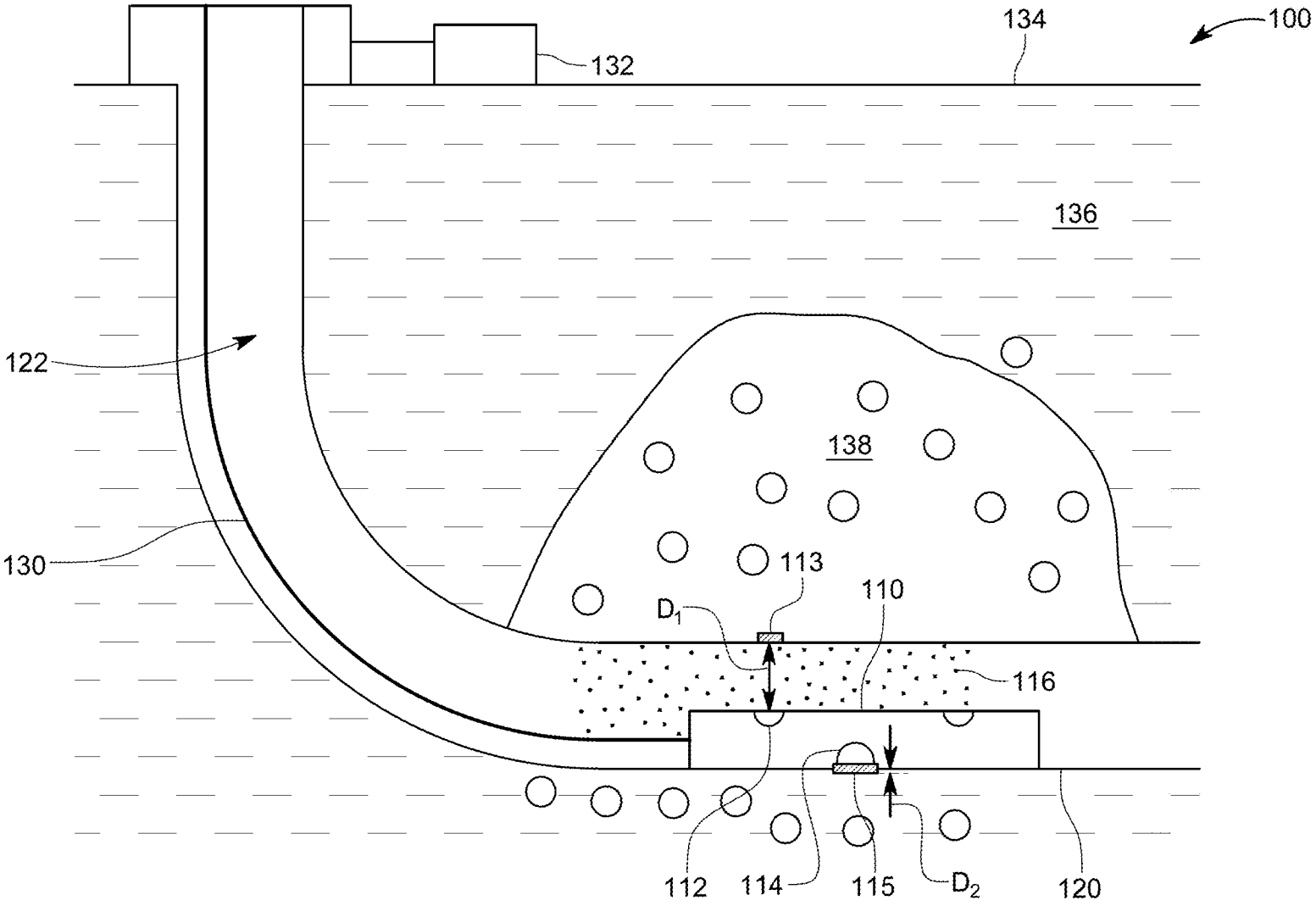
FIG. 1 illustrates a perforating gun placed in a casing of a well for making perforations into the casing.
Figure 2:
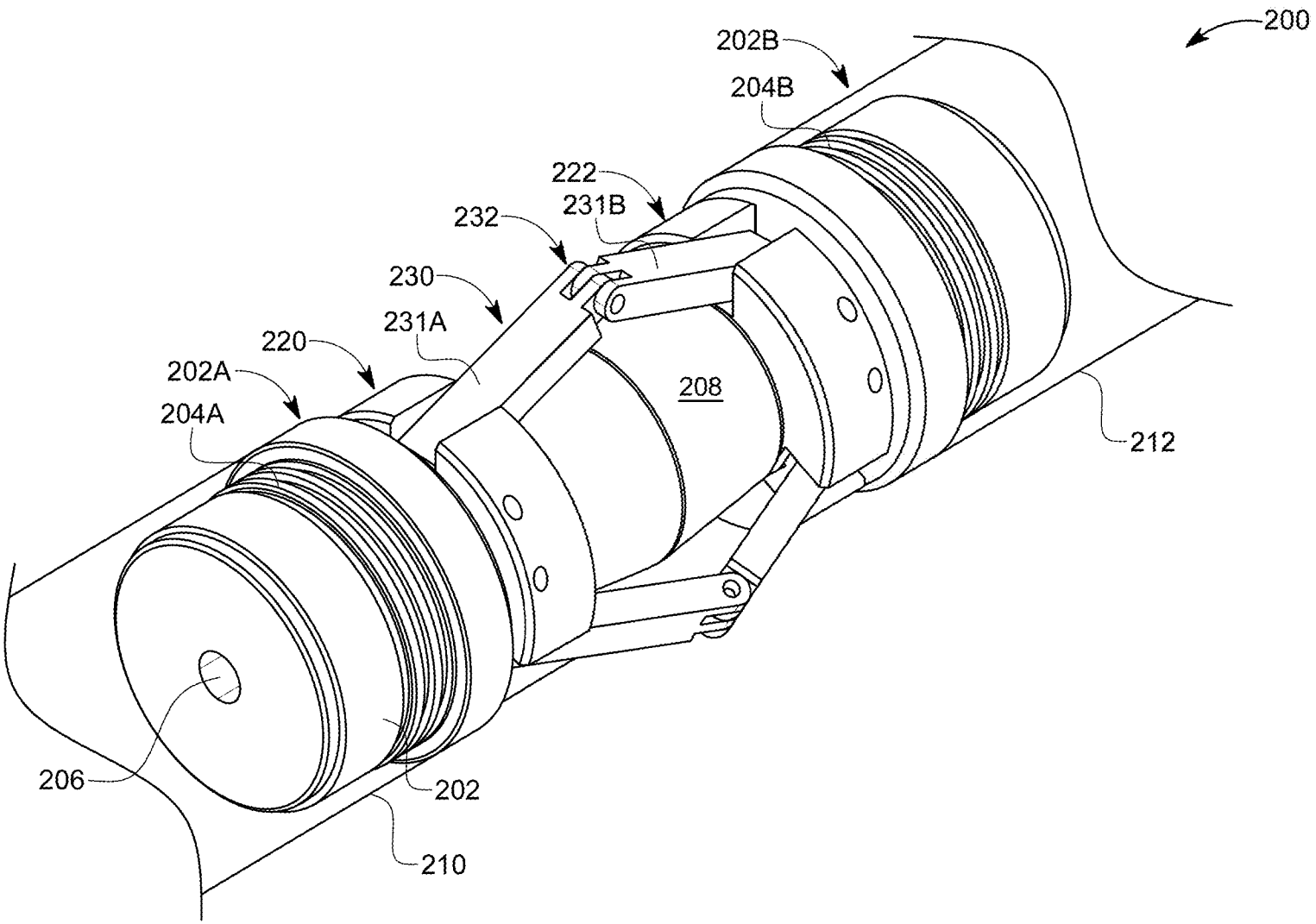
FIG. 2 illustrates a centralizing device that is configured to centralize/decentralize a tool attached to it.
Figure 3:
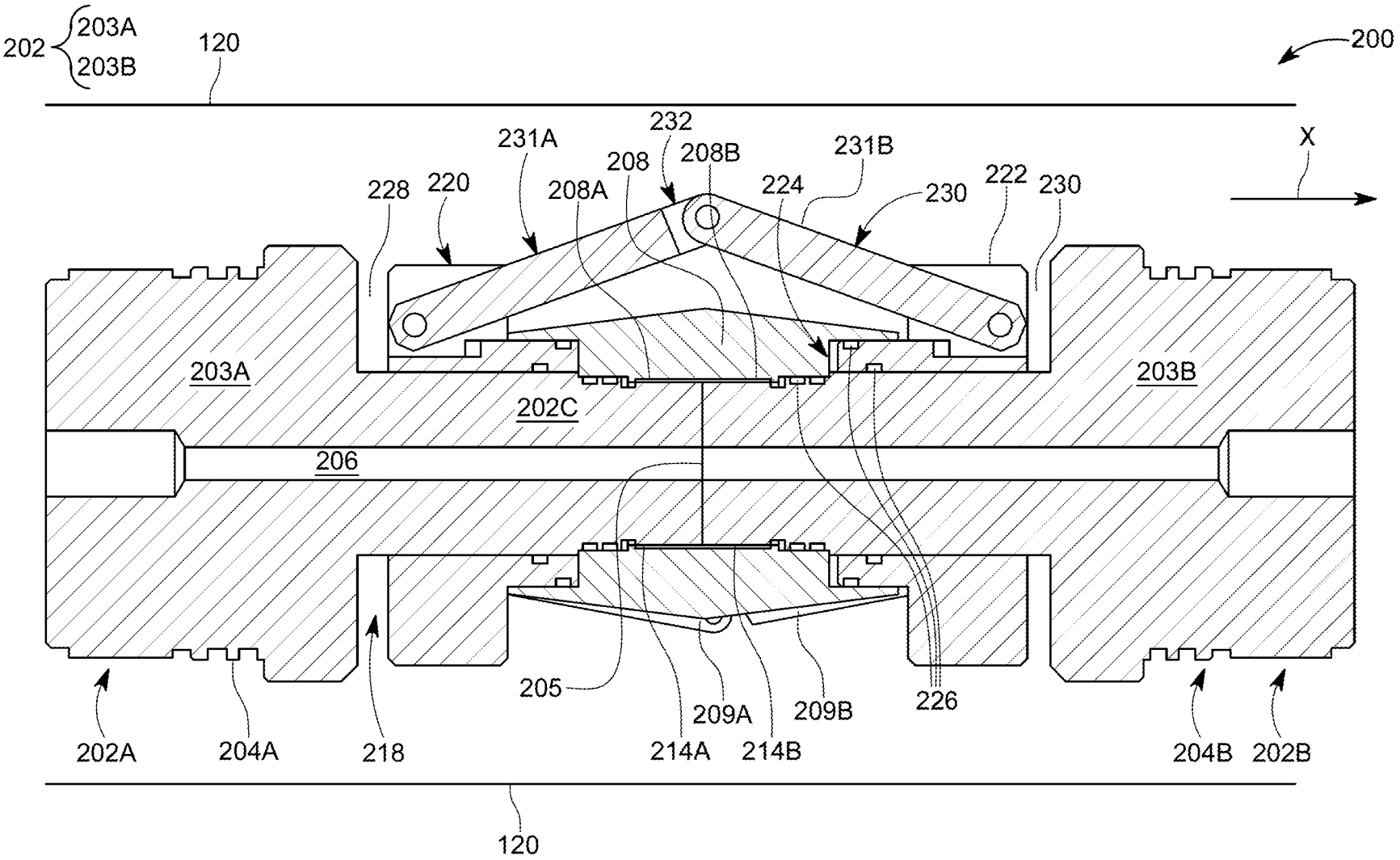
FIG. 3 is a cross-section of one embodiment of the centralizing device.

FIG. 2 is an overall view of a centralizing device 200, which has a body 202 that extends along a longitudinal axis X. The body 202 may be configured to have first threads 204A at a first end 202A, and second threads 204B at a second end 202B of the body. The threads are configured to connect to other tools in the well, for example a perforating gun 210 and a setting tool 212. Those skilled in the art would understand that the second tool 212 may also be a perforating gun. The tools 210 and 212 may be other oil and gas devices, not perforating guns. The body 202 has a bore 206 that extends throughout the body, as better shown in FIG. 3. As shown in FIG. 3, the body 202 that may be made of two parts 203A and 203B that are connected to each other by a bridge or middle centralizer part 208. An interface 205 between the two parts 203A and 203B is also shown in the figure. The bridge 208 may have threads 208A and 208B at each end, to engage corresponds threads 214A and 214B formed in the two parts 203A and 203B, respectively. The bridge 208 and the parts 203A and 203B may be made of steel or any other strong material so that the body 202 can hold together the two tools 210 and 212 attached to the ends of the centralizing device 200. The bridge 208 is shaped as a cylinder and fully encircles a middle portion 202C of the body 202. Due to the threads 208A and 208B, the bridge 208 does not translate relative to the central portion 202C of the body 202.

As better shown in the cross-section view shown in FIG. 3, the body 202 has a gap 218 circumferentially formed around the central portion 202C of the body 202, between the ends 203A and 203B, for accommodating the bridge 208, first and second pistons 220 and 222, and one or more pairs 230 of arms that connect the first and second pistons to each other. The slot 218 is thus characterized by making the central portion 202C to have a smaller diameter than the ends 202A and 202B of the body 202. FIG. 3 further shows that the pistons 220 and 222 fully encircle the central part 202C of the body 202, similar to the bridge 208. Thus, in one embodiment, the pistons 220 and 222 are shaped as a cylinder. In the embodiment shown in FIG. 3, the first piston is fixedly attached to the body 202 and/or to the bridge 208, while the second piston 222 is configured to slide along the axial direction X, relative to the body 202 and the bridge 208. The figure further shows a sealed chamber 224 defined by the second piston 222, the bridge 208, and the body 202. The sealed chamber 224 includes air at atmospheric or a higher pressure, which needs to be less than the hydrostatic pressure at the desired depth in the well where the device is expected to work. To seal the air inside the sealed chamber 224, plural o-rings 226 may be placed between the second piston and the bridge, between the body 202 and the bridge, and between the second piston and the body.

The placement of the first and second pistons and the bridge in the slot 218 of the body 202 determines the formation of two variable gaps 228 and 230, as also shown in FIG. 3. Because the variable gaps 228 and 230 are open to the ambient, which is the interior of the casing of the well when the centralizing device 200 is in the well, the pressure in the variable gaps increases as the centralizing device 200 moves toward a toe of the well. However, the pressure inside the sealed chamber 224 remains constant (as long as the pistons do not move) as the chamber is sealed. This means, as discussed later in more detail, that the pressure inside the variable gaps 228 and 230 becomes higher than the pressure inside the sealed chamber 224, which makes the second piston 222 to slide toward the first piston 220. Because the first piston 220 is fixed in place in this embodiment, the arms 231A and 231B of the pair 230 are starting to fold about the hinge 232, and to move toward the casing 120.

Note that while the arms 231A and 231B are attached with one end to each other at the hinge 232, the other ends of the arms are attached to corresponding pistons 220 and 222 in such a manner that the arms can rotate (pivot) relative to their attachment points. To prevent the arms 231A and 231B to impinge on the bridge 208 instead of the casing of the well, in one embodiment, the bridge 208 is shaped to have two arching sides 209A and 209B, which bias the arms to expand toward the casing. The amount of radial movement of the arms is a function of the arm angle, and the hydrostatic pressure.

Figure 4:
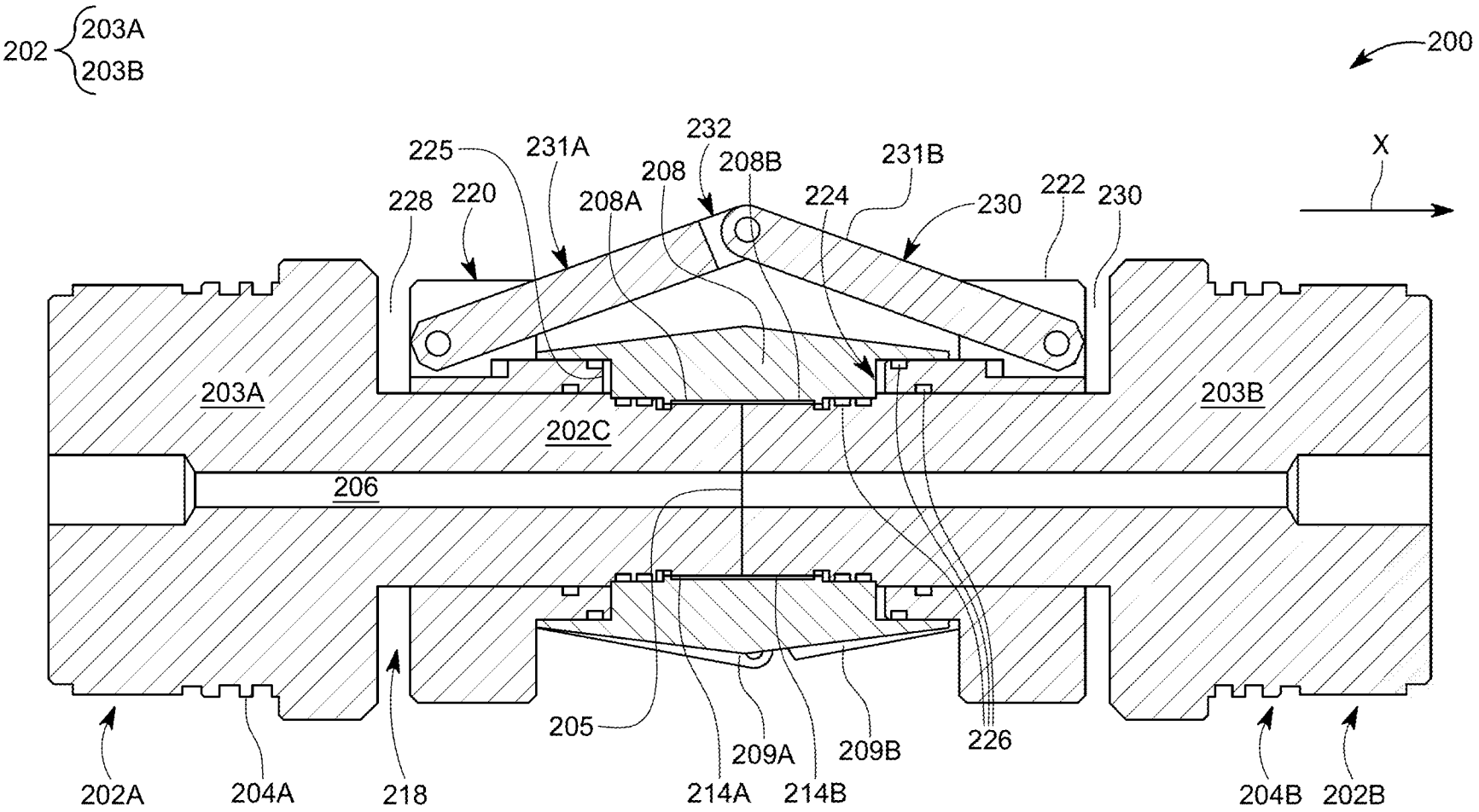
FIG. 4 is a cross-section of another embodiment of the centralizing device.
Figure 5:
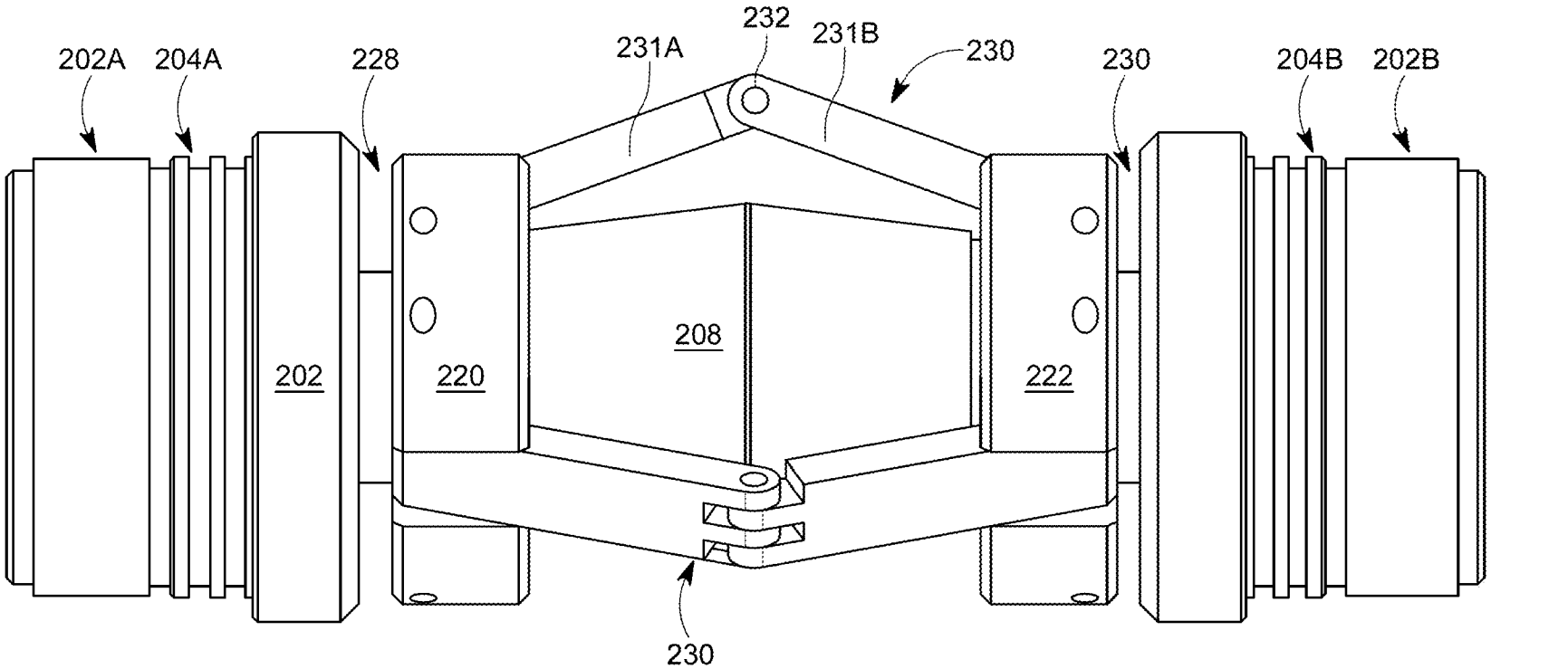
FIG. 5 is a side view of the centralizing device.
Figure 6:
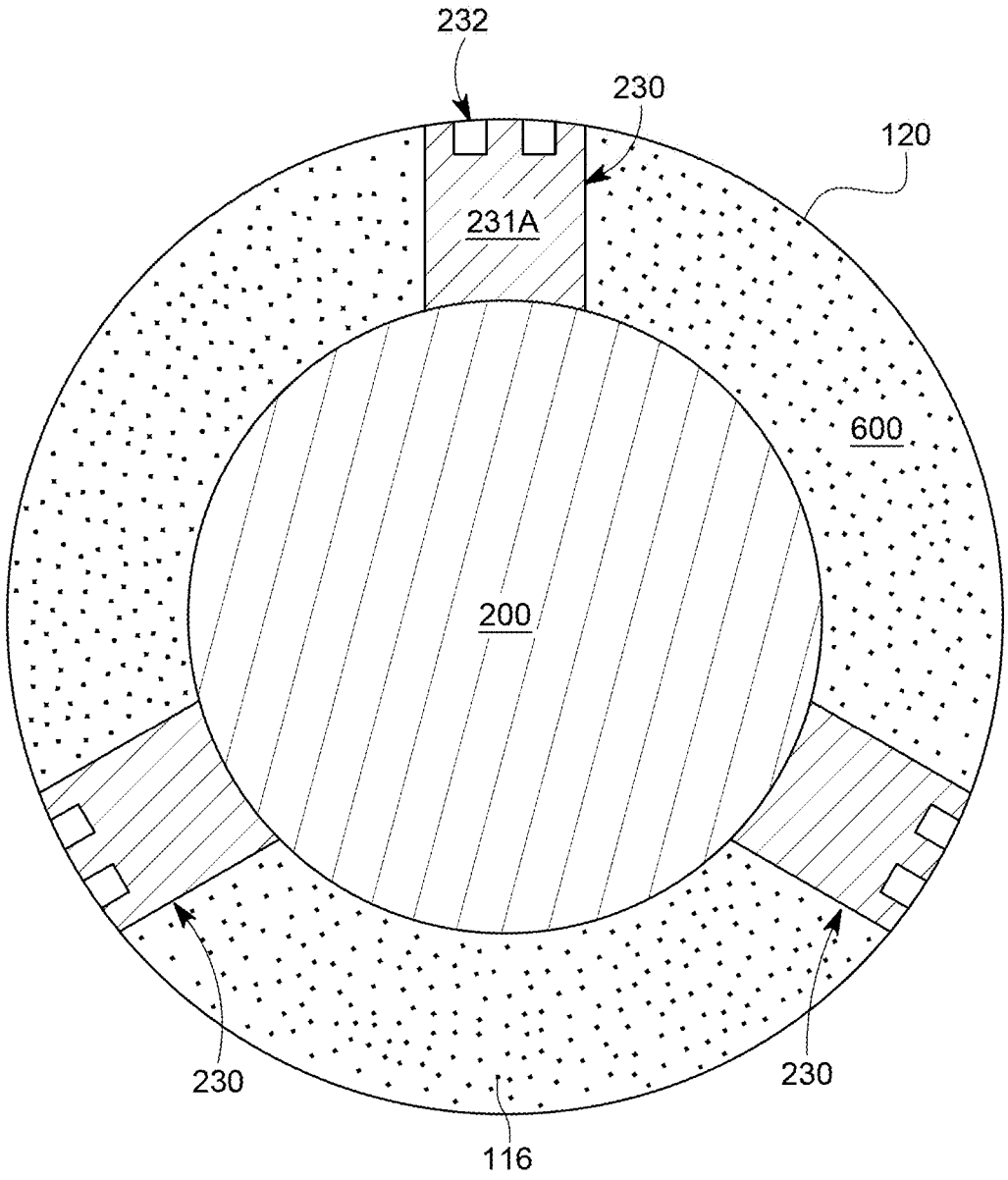
FIG. 6 shows a cross-section view of the centralizing device configured to centralize the tool.

The embodiment shown in FIG. 3 shows a single sealed chamber 224 formed by the second piston 222 with the bridge 208 and the body 202. However, as illustrated in FIG. 4, it is also possible to have an additional sealed chamber 225, which is formed by the first piston 220 with the bridge 208 and the body 202. For this case, both the first and second pistons 220 and 222 can slide along the axial direction X, toward each other, for folding the arms 231A and 232B so that the hinge 232 moves toward the casing. Note that each arm is attached to pivot to the corresponding piston. A side view of the centralizing device 200 is shown in FIG. 5. Although FIG. 5 shows only two pairs 230 of arms 231A and 231B, in this embodiment, there are three pairs of arms uniformly distributed (i.e., with the same angle) along the circumference of the body 202. In other words, on an angular axis, two adjacent pairs 230 make a 120 angle with each other, i.e., they are symmetrically distributed around the circumference of the body of the centralizing device 200, as illustrated in FIG. 6. For this case, the longitudinal axis X of the body 202 of the centralizer device 200 is sitting on the central axis of the casing 120 so that the tools attached to the centralizer device are concentric with the casing. Note that the annulus 600 shown in FIG. 6 may include the ambient fluid that is present in the casing, for example, a mixture of oil, water, mud, etc.

Figure 7:
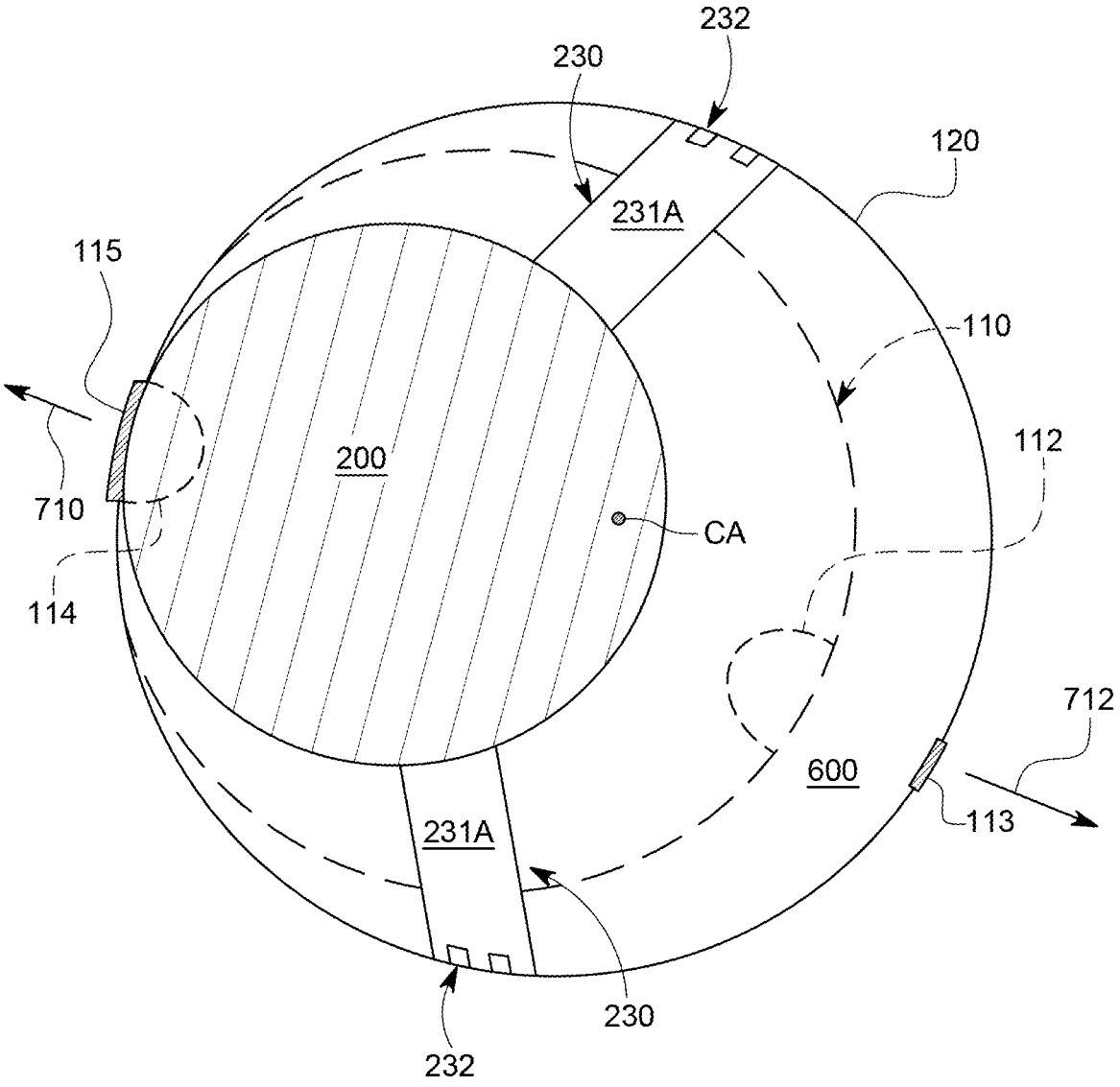
FIG. 7 shows a cross-section view of another centralizing device configured to decentralize the tool.
Figure 8:
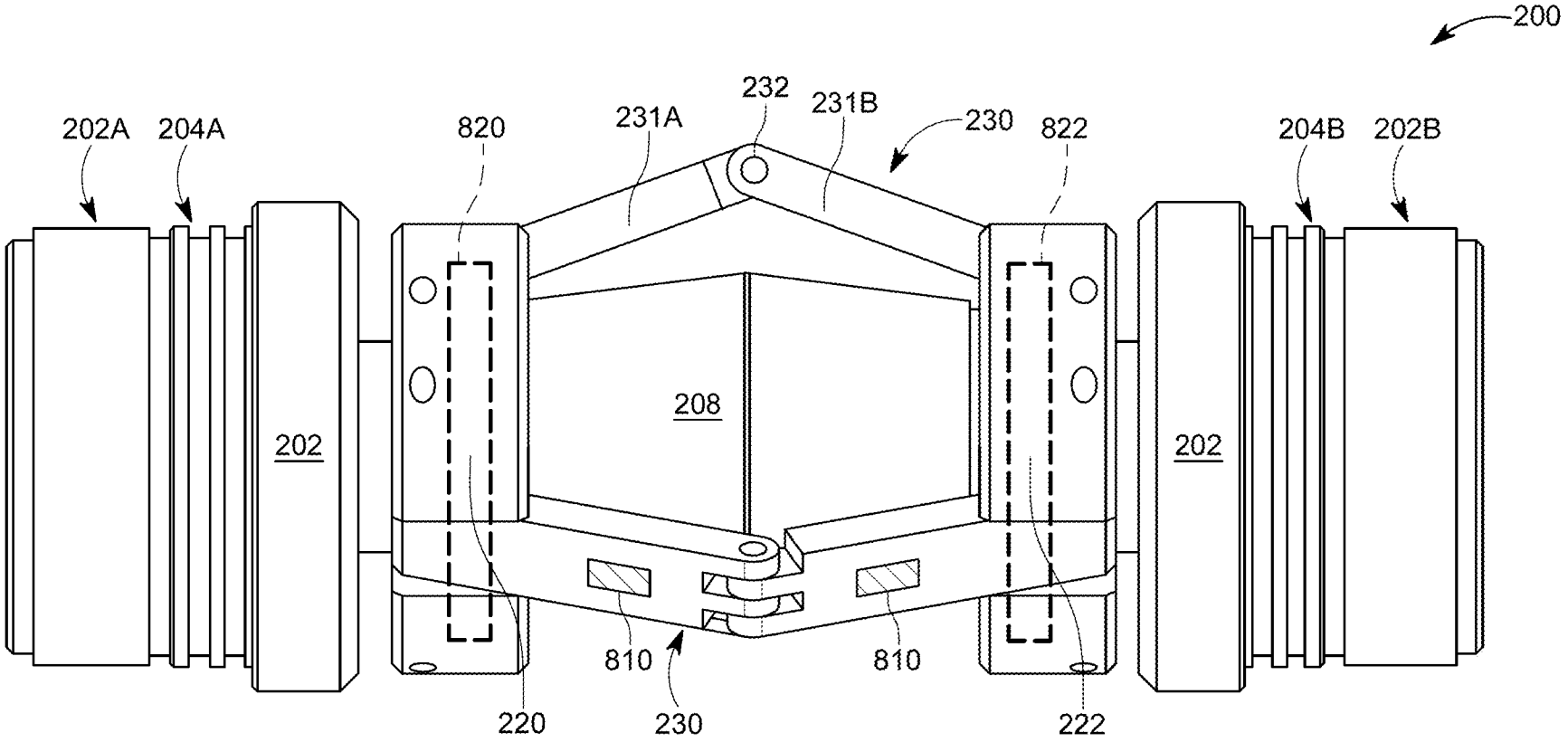
FIG. 8 shows a side view of a centralizing device having internal bearings for achieving a specific orientation.

However, in a different embodiment, only one or only two pairs 230 of arms are distributed around the circumference of the body 202 to decentralize the tools to which the centralizing device is attached, and this is configured as such on purpose to achieve the decentralization. For example, in the embodiment illustrated in FIG. 7, it is desired that the perforating gun 110 makes larger perforations in one direction 710 and smaller perforations in the opposite direction 712. For this case, only two pairs 230 of arms are provided on the centralizer device 200, as illustrated in the figure. Thus, the centralizer device and the associated perforating gun are decentralized from the central axis CA of the casing 120, to achieve the desired perforation diameters. Thus, in the embodiment of FIG. 6, the pairs of arms are symmetrically distributed around the body to centralize the tool relative to a central axis of the well while in the embodiment of FIG. 7, the pairs of arms are asymmetrically distributed around the body to decentralize the tool relative to the central axis CA of the well.

Figure 9:
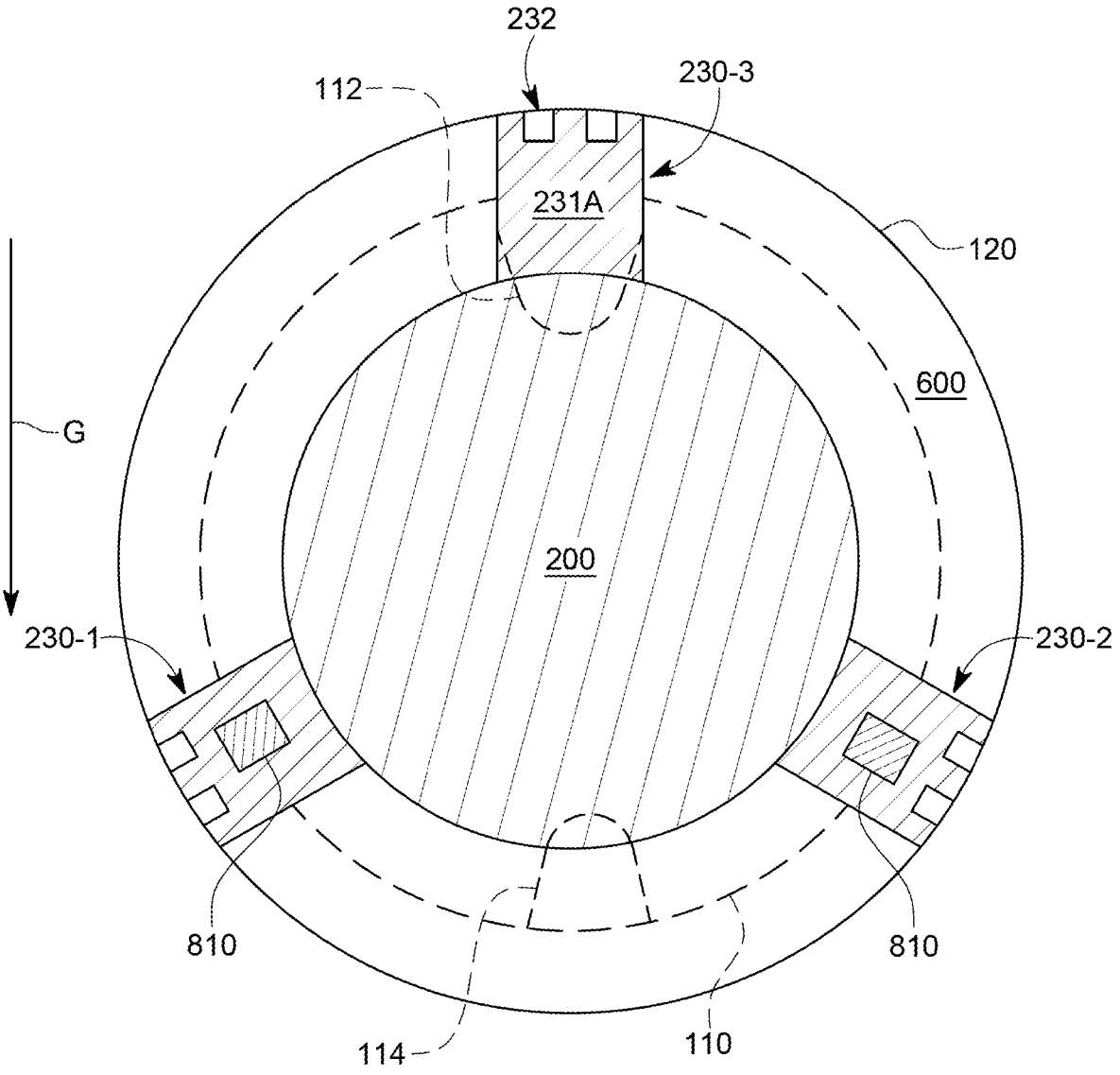
FIG. 9 shows a cross-section view of a centralizing device having pairs of arms angularly distributed around a circumference of a body of the centralizing device to achieve a centralization of the attached tool.

In one embodiment, it is desired that the centralizer device 200 not only centralizes or decentralizes the associated tool, but also orients the tool relative to the vertical direction of the gravity. In other words, suppose that the tool is a perforating gun and it is desired to centralize the perforating gun but it is also desired to have some shaped charges that are oriented to shoot vertically upward and some other shaped charges that are oriented to shoot vertically downward. For this case, the centralizer device 200 may be modified to have bearing races 820 and 822 (or equivalent devices that allow the rotation of one element relative to another one), located between the corresponding pistons 220 and 222, respectively, and the central portion 202C of the body 202 so that the pairs 230 of arms can freely rotate along the longitudinal axis of the body 202. In addition, a weight 810 may be added to each arm of one or two pairs of arms to bias the pistons to rotate to a desired orientation, as illustrated in FIG. 9. FIG. 9 shows that two pairs 230-1 and 230-2 of arms are provided with corresponding weights 810 while the third pair 230-3 of arms is not. Because of the weights 810, and because of the bearing races 820 and 822 (not shown in the figure), the two weighted pairs 230-1 and 230-2 take the lowest possible position relative to the gravity G, while the un-weighted pair 230-3 takes the highest possible position relative to the gravity G. For this reason, if the shaped charge 112 of the attached perforating gun 110 has been aligned with the un-weighed pair 230-3, as schematically illustrated in FIG. 9, and the shaped charge 114 has been placed between the weighted pairs 230-1 and 230-2 (along the angular axis), then the shaped charge 112 is oriented vertically upward and the shaped charge 114 is oriented vertically downward as soon as the centralizing device 200 is actuated by the hydrostatic pressure.

In this regard, note that the air pressure inside the sealed chamber 224 may have any desired value as this pressure is set at the surface, before the centralizing device is attached to the corresponding tools. Based on this capability, the operator of the tool may determine that the tool should be centralized and/or oriented at a given depth H, which is associated with a corresponding well pressure. Thus, it is possible to compress the air inside the sealed chamber 224, at the surface, to have a pressure equal to the well pressure at the corresponding depth H. This means that once the centralizing device is deployed in the well, it will not be activated until the centralizing device arrives at the given depth H, when the hydrostatic pressure inside the well becomes equal to or larger than the pressure inside the sealed chamber. Thus, at this point, the pistons are activated, i.e., they start to move toward each other, and the arms 231A and 231B of each pair 230 start to fold and reach the casing 120. If the arms are weighted and have the bearings 820 and 822, the arms start rotating around the body 202 until they reach their lowest potential energy. The arms reach this equilibrium position before reaching the casing 120. Thus, when the arms (the hinge 232) start pressing against the casing 120, they are already oriented as desired, and thus, the orientation of the shaped charges 112 and 114 (see FIG. 9) is achieved just before pressing against the casing. As the hinges 232 of the arms press against the casing, the centralizing device and the associated tools become centralized (or decentralized) relative to the central axis of the casing, as desired by the operator.

Figure 10:
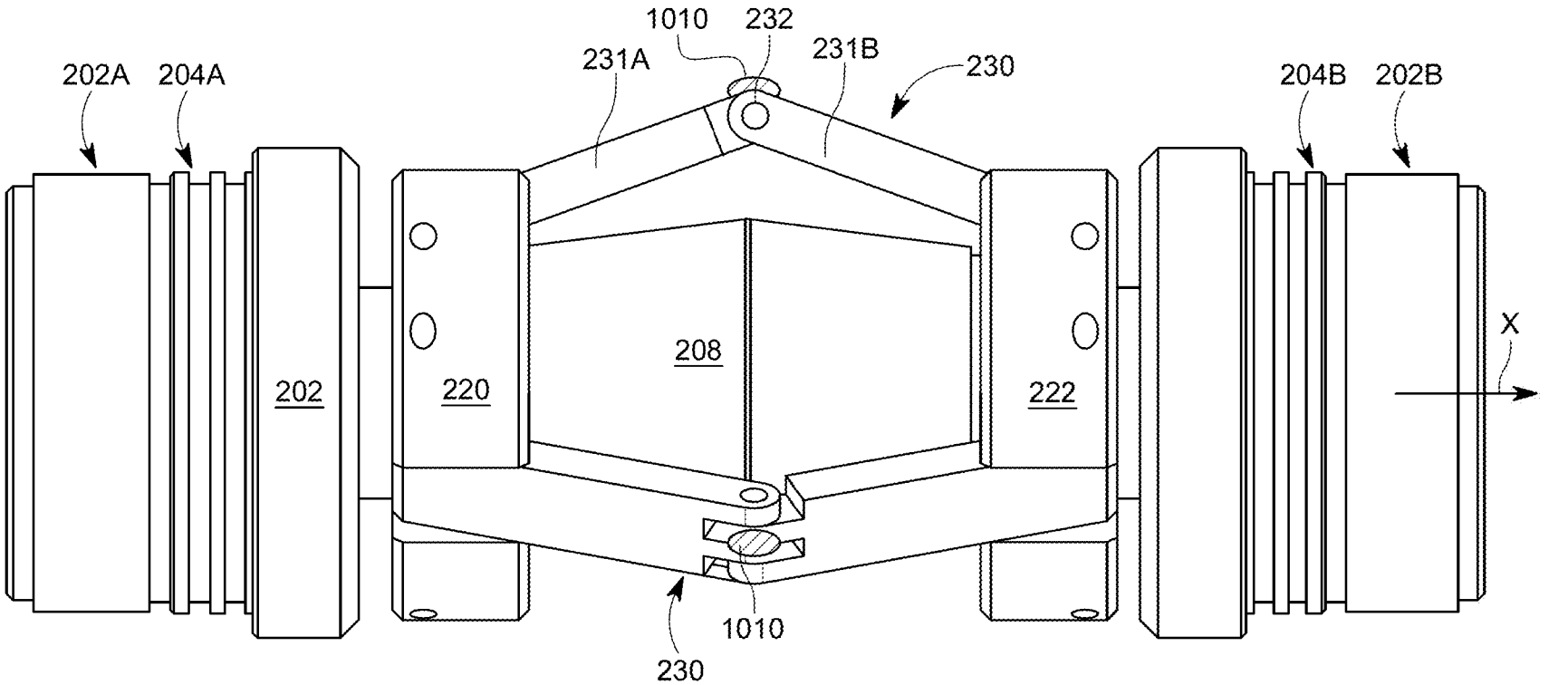
FIG. 10 shows a centralizing device having rollers disposed at a joint of a pair of arms.

In one embodiment, as illustrated in FIG. 10, the arms 231A and 231B may be provided with a rolling device 1010 (e.g., a roller) that is configured to roll when in contact with the casing 120. The rolling device 1010 may be attached to the hinge 232. In this way, the centralizing device 200 not only can centralize the attached tools, but also can move into the well along the longitudinal axis X, while simultaneously pressing against the casing 120.

Figure 11:
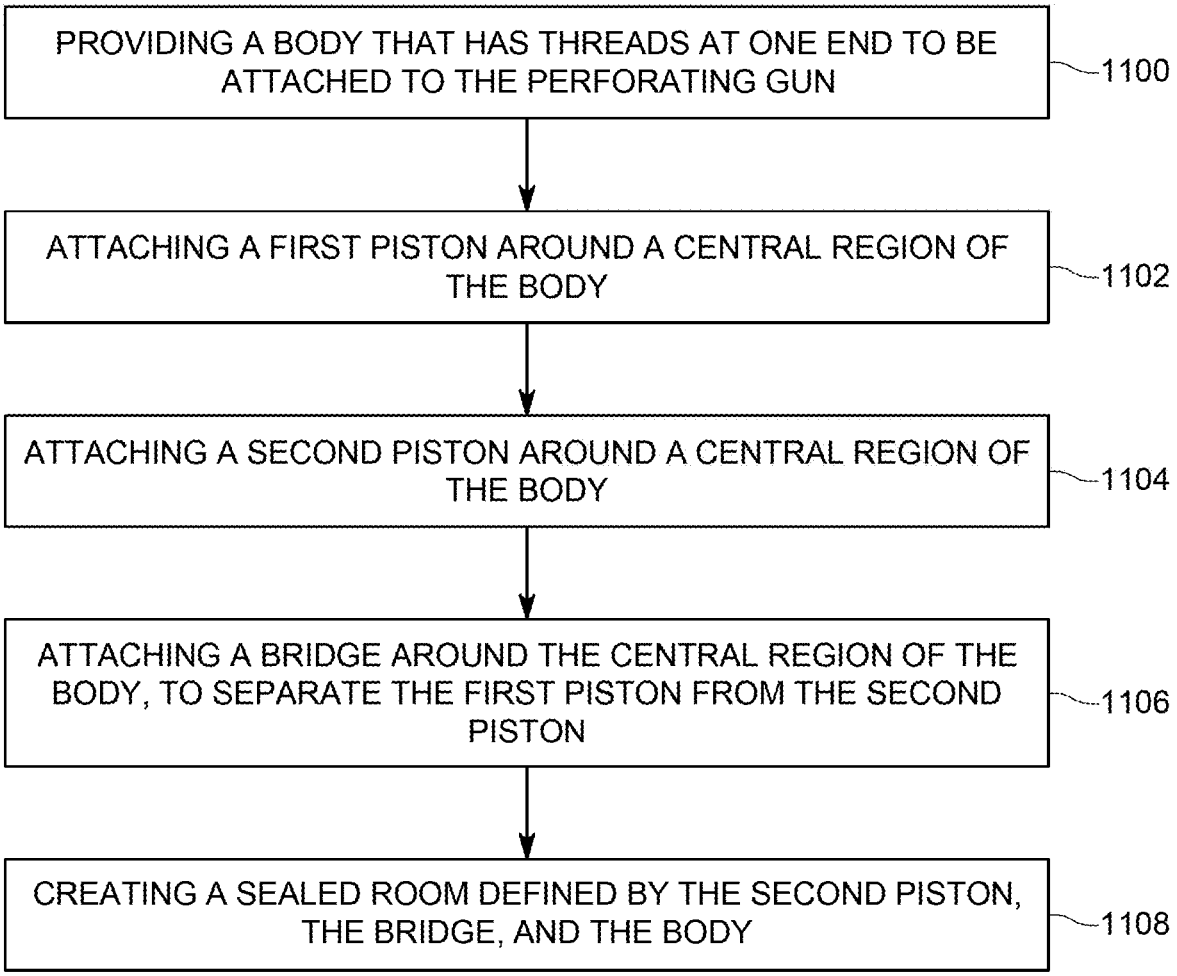
FIG. 11 is a flow chart of a method for assembling a centralizing device.

A method for manufacturing the centralizing device 200 to be attached to the perforating gun 210 is now discussed with regard to FIG. 11. The method includes a step 1100 of providing a body that has threads at one end to be attached to the perforating gun, a step 1102 of attaching a first piston around a central region of the body, a step 1104 of attaching a second piston around the central region of the body, a step 1106 of attaching a bridge around the central region of the body, to separate the first piston from the second piston, and a step 1108 of creating a sealed room defined by the second piston, the bridge, and the body. The sealed room is sealed from the ambient.

In another embodiment, it is possible to have the sealed chamber filed initially with water, which is incompressible. For this situation the arms are closed. A valve may be connected between the sealed chamber and an additional air sealed chamber. When an instruction from the surface is sent to the centralizing device, the valve may be opened, and the liquid from the sealed chamber is allowed to enter into the air sealed chamber, and thus, the arms can be opened. This is an embodiment in which the centralizing device is operated by a command from the surface. Those skilled in the art, based on teachings presented herein, would understand that other variations of the centralizing device may be implemented without deviating from the scope of the embodiments discussed herein.

The disclosed embodiments provide methods and systems for centralizing or decentralizing associated tools inside a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A centralizing device configured to centralize/decentralize an associated tool in a well, the centralizing device comprising:

a body that extends along a longitudinal axis, the body having a bore that extends from one end to another end of the body;

a first piston shaped as a cylinder and provided around a central portion of the body;

a second piston shaped as a cylinder and provided around the central portion of the body;

a bridge provided around the central portion of the body, between the first and second pistons; and a pair of arms, each arm being attached with one end to a corresponding one of the first and second pistons and with another end to each other, wherein the second piston, the bridge, and the central portion of the body define a first sealed chamber containing a gas that exerts a pressure tending to separate the first piston and the second piston.

2. The centralizing device of claim 1, wherein the first piston, the bridge, and the central portion of the body form a second sealed chamber.

3. The centralizing device of claim 2, wherein the gas contained within the first sealed chamber comprises air at a given pressure.

4. The centralizing device of claim 3, wherein the centralizing device is configured such that a hydrostatic pressure inside the well tends to move the first piston and the second piston towards each other so that the pair of arms fold and a joint of the arms moves radially away from the longitudinal axis.

5. The centralizing device of claim 1, wherein the gas contained within the first sealed chamber comprises air at a given pressure.

6. The centralizing device of claim 5, wherein the centralizing device is configured such that a hydrostatic pressure inside the well tends to move the first piston and the second piston towards each other so that the pair of arms fold and a joint of the arms moves radially away from the longitudinal axis.

7. The centralizing device of claim 1, wherein the second piston forms with the body a variable gap, that communicates with an ambient environment within the well.

8. The centralizing device of claim 7, wherein the second piston is configured to move along the longitudinal axis, under a hydrostatic pressure formed in the variable gap, to reduce a size of the first sealed chamber.

9. The centralizing device of claim 1, wherein at least one of the one end or the another end of the body is configured to be attached to a perforating gun.

10. The centralizing device of claim 1, further comprising:

additional pairs of arms, each pair connected between the first and second pistons.

11. The centralizing device of claim 10, wherein the pair of arms and the additional pairs of arms are symmetrically distributed around the body to centralize the tool relative to a central axis of the well.

12. The centralizing device of claim 10, wherein the pair of arms and the additional pairs of arms are asymmetrically distributed around the body to decentralize the tool relative to a central axis of the well.

13. The centralizing device of claim 1, further comprising:

a roller attached to a joint of the pair of arms.

14. The centralizing device of claim 1, further comprising:

a weight attached to the pair of arms to obtain a desired orientation of the body relative to gravity.

* * * * *